US005233912A

United States Patent [19]

Mueller

[11] Patent Number: 5,233,912

[45] Date of Patent: Aug. 10, 1993

[54] PISTON FOR FORCING LIQUID METAL OUT OF A CASTING CYLINDER

[75] Inventor: Andre Mueller, Ependes, Switzerland

[73] Assignee: Allper AG, Duedingen, Switzerland

[21] Appl. No.: 919,258

[22] Filed: Jul. 27, 1992

[30] Foreign Application Priority Data

Jul. 29, 1991 [EP] European Pat. Off. ..... 91112740.5

[51] Int. Cl.[5] ..... F01B 9/00

[52] U.S. Cl. ..... 92/29; 92/255; 403/348; 403/349; 277/16; 277/181; 277/168

[58] Field of Search ..... 92/29, 186, 240, 84, 92/186, 255; 403/348, 349; 277/16, 181, 168

[56] References Cited

U.S. PATENT DOCUMENTS

| | | | |
|---|---|---|---|
| 2,844,422 | 7/1958 | Wankel | 277/168 |
| 2,844,424 | 7/1958 | Goetze | 277/168 |
| 2,862,738 | 12/1958 | Bayley | 403/349 |
| 2,901,258 | 8/1959 | Brandafi | 403/349 |
| 4,036,113 | 7/1977 | Kunz . | |
| 4,529,330 | 7/1985 | Boski | 403/348 |
| 5,048,592 | 9/1991 | Mueller | 92/255 |
| 5,094,148 | 3/1992 | Haber et al. | 92/255 |

FOREIGN PATENT DOCUMENTS

| | | | |
|---|---|---|---|
| 0423413 | 4/1991 | European Pat. Off. . | |
| 1029615 | 5/1958 | Fed. Rep. of Germany | 277/168 |
| 2446503 | 4/1976 | Fed. Rep. of Germany . | |
| 2904883 | 7/1979 | Fed. Rep. of Germany . | |
| 8034487 | 5/1985 | Fed. Rep. of Germany . | |
| 3934778 | 7/1990 | Fed. Rep. of Germany . | |
| 9014003 | 12/1990 | Fed. Rep. of Germany . | |

*Primary Examiner*—Thomas E. Denion
*Attorney, Agent, or Firm*—Foley & Lardner

[57] ABSTRACT

A piston for forcing a liquid metal out of a casting cylinder of a die-casting press, having a mounting piece with an end surface and an outer peripheral surface; and a cap having an inner cover surface, an inner peripheral surface, and a free edge surface. The cap is mounted on the mounting piece so that the inner cover surface faces the end surface, and the inner peripheral surface has, proximate to said free edge surface, a plurality of notches formed therein. The outer peripheral surface has a plurality of bayonet-catch projections extending therefrom which are received in the plurality of notches.

15 Claims, 4 Drawing Sheets

PISTON FOR FORCING LIQUID METAL OUT OF A CASTING CYLINDER

BACKGROUND OF THE INVENTION

1. Field of the Invention

The invention relates to a piston, and in particular to a piston for forcing liquid metal, preferably liquid aluminum or liquid brass, out of a casting cylinder of a die-casting press, the piston having a cap which is mounted on and attached to the mounting piece in such a way that the cap faces, with its inner cover surface, an end face of the mounting piece.

2. Description of the Related Art

A piston of the above-mentioned type is disclosed in EP-A2-423 413, where the cap is shown as being thermically screwed by an inner thread onto an outer thread of the mounting piece. However, in this arrangement, the mounting and attachment of the cap to the mounting piece is very time consuming.

SUMMARY OF THE INVENTION

An object of the invention is to facilitate the mounting and attachment of the cap to the mounting piece in order to enable the cap to be quickly replaced so that the corresponding down times of the machine in which the piston operates are reduced.

This object is met by providing a piston for forcing a liquid metal out of a casting cylinder of a die-casting press, having a mounting piece with an end surface and an outer peripheral surface; and a cap having an inner cover surface, an inner peripheral surface, and a free edge surface. The cap is mounted on the mounting piece so that the inner cover surface faces the end surface. Additionally, the inner peripheral surface has, proximate to the free edge surface, a plurality of notches formed therein, and the outer peripheral surface has a plurality of bayonet-catch projections extending therefrom which are received in the plurality of notches.

Another object of the invention is to be able to detach the cap from the mounting piece or attach the cap to the mounting piece after just a ⅛ turn in relation to the mounting piece. This object is accomplished by providing a piston as discussed above, and wherein four bayonet-catch projections are disposed around the outer peripheral surface such that an angular distance between any two adjacent projections is equal. Each of the bayonet-catch projections correspond to one of the plurality of notches.

Another object of the invention is to obtain a type of pumped cooling of the cap via a cooling circuit as described in EP-A2-423 413.

This object is met by providing a piston as previously described, the piston having a plurality of notches each having an axial dimension which is larger than an axial dimension of each of the bayonet-catch projections, thereby allowing the inner cover surface and the end surface to move relative to each other along a longitudinal axis of the piston. The axial dimensions of the plurality of notches and the plurality of bayonet-catch projections are measured along the longitudinal axis of the piston.

A further object of the invention is secure the cap easily on the mounting piece.

This object is met by providing a piston having a free edge surface which has a rounded recess therein for receiving a head portion of a screw which is screwed into the mounting piece.

In yet another embodiment of the invention, the cap is provided, in the front area of its periphery, with a conventional sealing ring, such as that disclosed in EP-A2 423 413. The sealing ring embraces, via its inner peripheral groove, an outer peripheral land on the cap, and has in front of the peripheral groove a cylindrical inner peripheral surface which surrounds, at a distance, two axially aligned cylindrical outer peripheral surface sections of the cap. The front cylindrical outer peripheral surface of the cap has a larger diameter than the rear cylindrical outer peripheral surface. Thus, the rear cylindrical outer peripheral surface is configured such that it forms a retaining undercut for solidified liquid metal. The solidified liquid metal in the retaining undercut spreads the sealing ring apart and thereby increases its sealing effect.

The sealing ring of this embodiment is held tight by the peripheral land on the cap. The front boundary surface of the peripheral land forms a stop face for the sealing ring, absorbs an axial pressure acting upon the sealing ring, and bounds a sealing zone to the sealing ring. Accordingly, the cap preferably exhibits, at a short distance from a rear end face of the sealing ring, a forward-pointing annular surface.

Moreover, in order to exploit, for sealing purposes, the liquid metal which is forced axially over the outer peripheral surface of the sealing ring, the cap preferably has, behind the sealing ring, a section of reduced outer diameter which defines a storage zone between itself and the inner surface of a casting cylinder. If metal enters this storage zone, the user recognizes that the sealing ring is no longer providing a complete seal and therefore needs to be replaced.

BRIEF DESCRIPTION OF THE DRAWINGS

The invention is explained below by means of illustrative embodiments, with reference to the appended drawings in which.

DETAILED DESCRIPTION OF THE PREFERRED EMBODIMENTS

Figure 1:
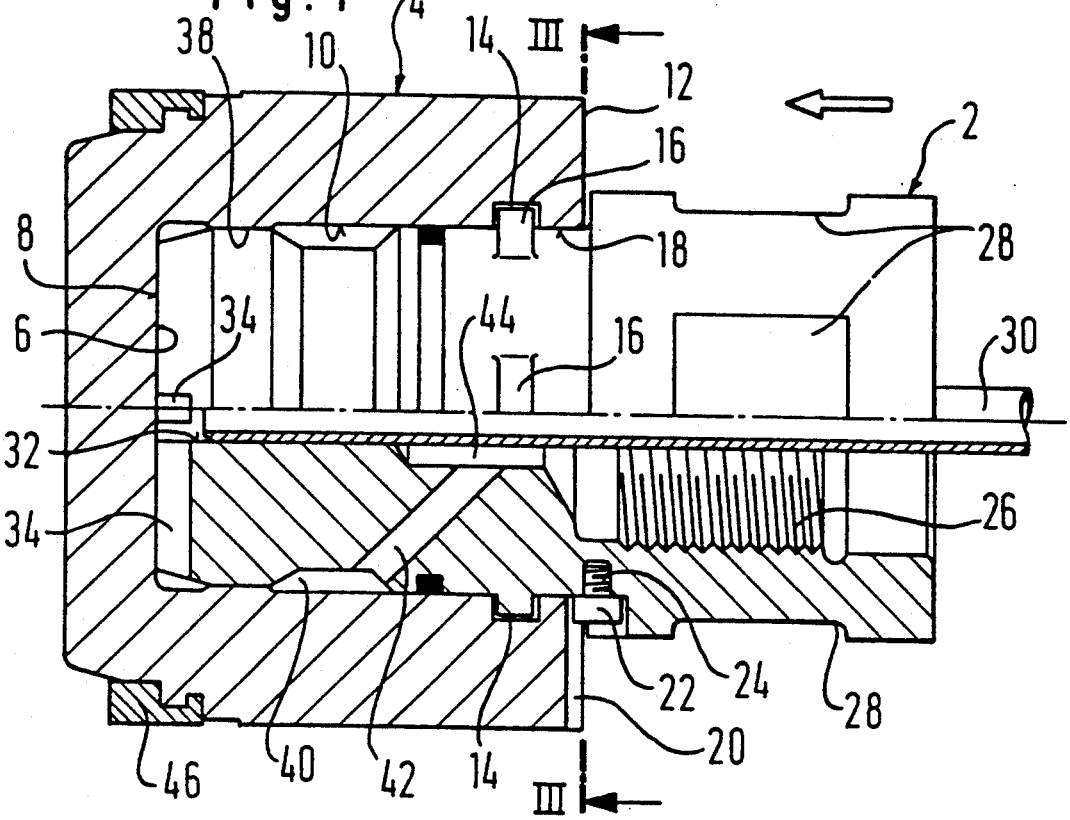
FIG. 1 is an axial section, partly in side view, showing a cap located on a mounting piece, the mounting piece being pushed forward relative to the cap.

Details of a standard die-casting press may be seen in EP-A2 423 413, the disclosure of which is incorporated by reference herein.

The piston according to the illustrative embodiment includes a cap 4 which is to be secured to a mounting piece 2, and which acts as a piston. The cap 4 faces, with an inner cover surface 6, an end face 8 of the mounting piece 2. The inner peripheral surface 10 of the cap 4 has, close to its free edge surface 12, four notches 14, which are equally spaced around the circumference of the inner peripheral surface, for receiving a corresponding number of four bayonet-catches 16 which are located on the periphery 18 of the mounting piece 2. The axial dimensions of the notches 14 which receive the bayonet-catch projections 16 allow for an axial movement of the projections, as is evident from FIGS. 1 and 2, thereby permitting temperature elongations of the cap 4, between the inner cover surface 6 of the cap 4 and the end face 8 of the mounting piece 2. The axial dimensions of the notches 14 are somewhat larger than the axial dimensions of the bayonet-catch projections 16, and preferably 0.1 to 0.2 mm larger.

In order to fix cap 4 to mounting piece 2, cap 4 has in its free edge surface 12, a rounded recess 20 for receiving a head part 22 of a screw 24 which is screwed into the mounting piece 2.

The mounting piece 2 is provided with an inner thread 26 which screws onto an outer thread of a piston rod (not shown). For the purpose of screwing-on the mounting piece to the piston head, screw collars 28, designed to be compatible with a U-key, are located on the outer surface of the mounting piece 2.

The piston rod and the mounting piece 2 are axially traversed by a tube 30, which ends in a bore 32 in front of the end face 8 of the mounting piece 2. Through the tube 30, a coolant can be forced into a radial duct 34 in the end face 8 of the mounting piece. The coolant then flows back through axial recesses 36 located in a front annular supporting surface 38 of the mounting piece 2, via an annular channel 40 and obliquely running bores 42, into an annular space 44 which is configured in the mounting piece 2 and surrounds the tube 30. From there, the coolant passes through the mounting piece 2. Details of this type of cooling are described in EP-A2-423 413.

Figure 2:
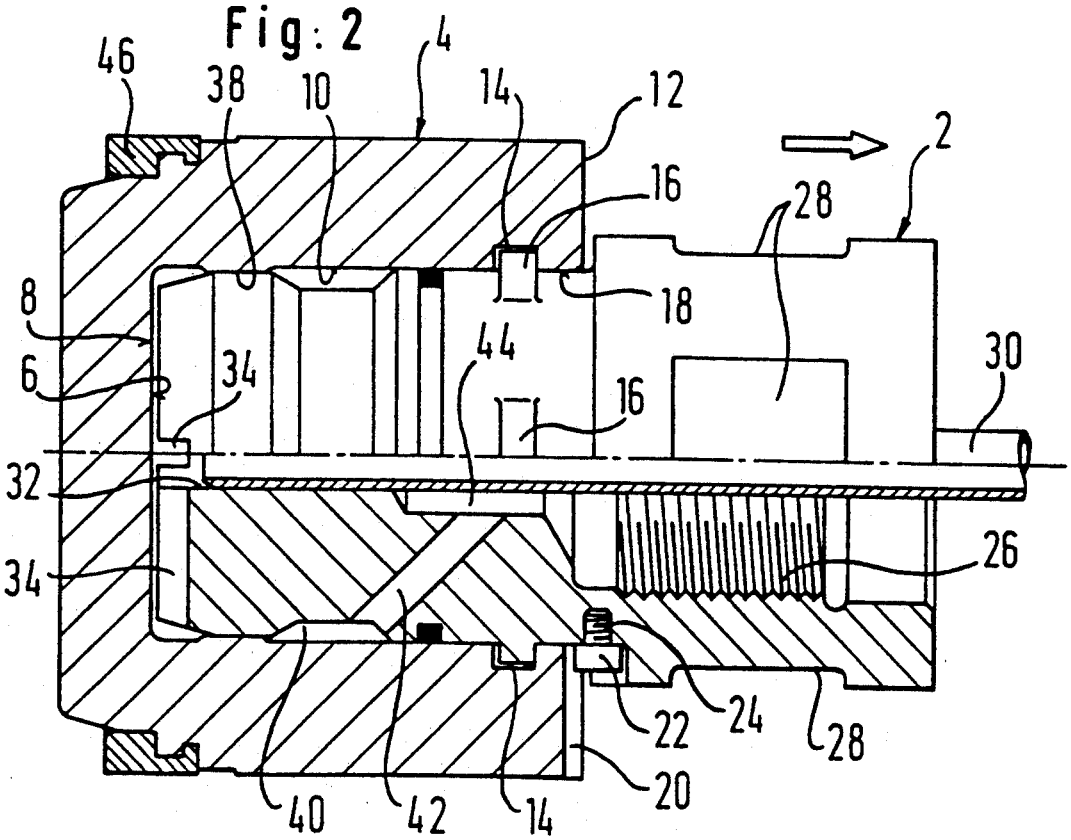
FIG. 2 is a view corresponding to FIG. 1, except that the mounting piece is drawn back relative to the cap.
Figure 3:
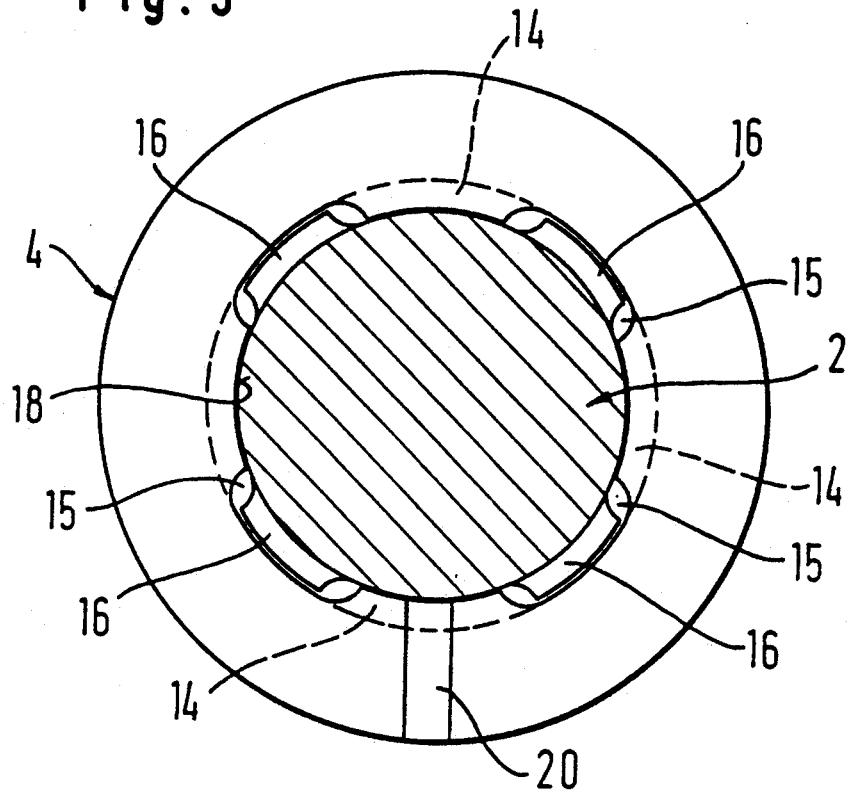
FIG. 3 is a view of a section along III—III in FIG. 1, in which the cap is not yet locked.
Figure 4:
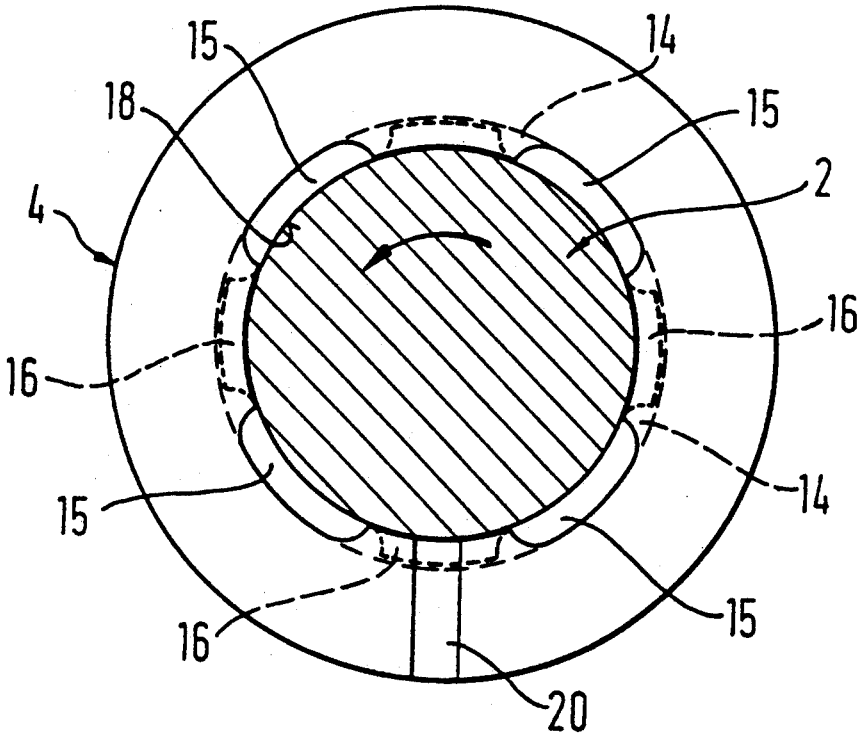
FIG. 4 is a view, corresponding to FIG. 3, and showing the cap as being locked.
Figure 5:
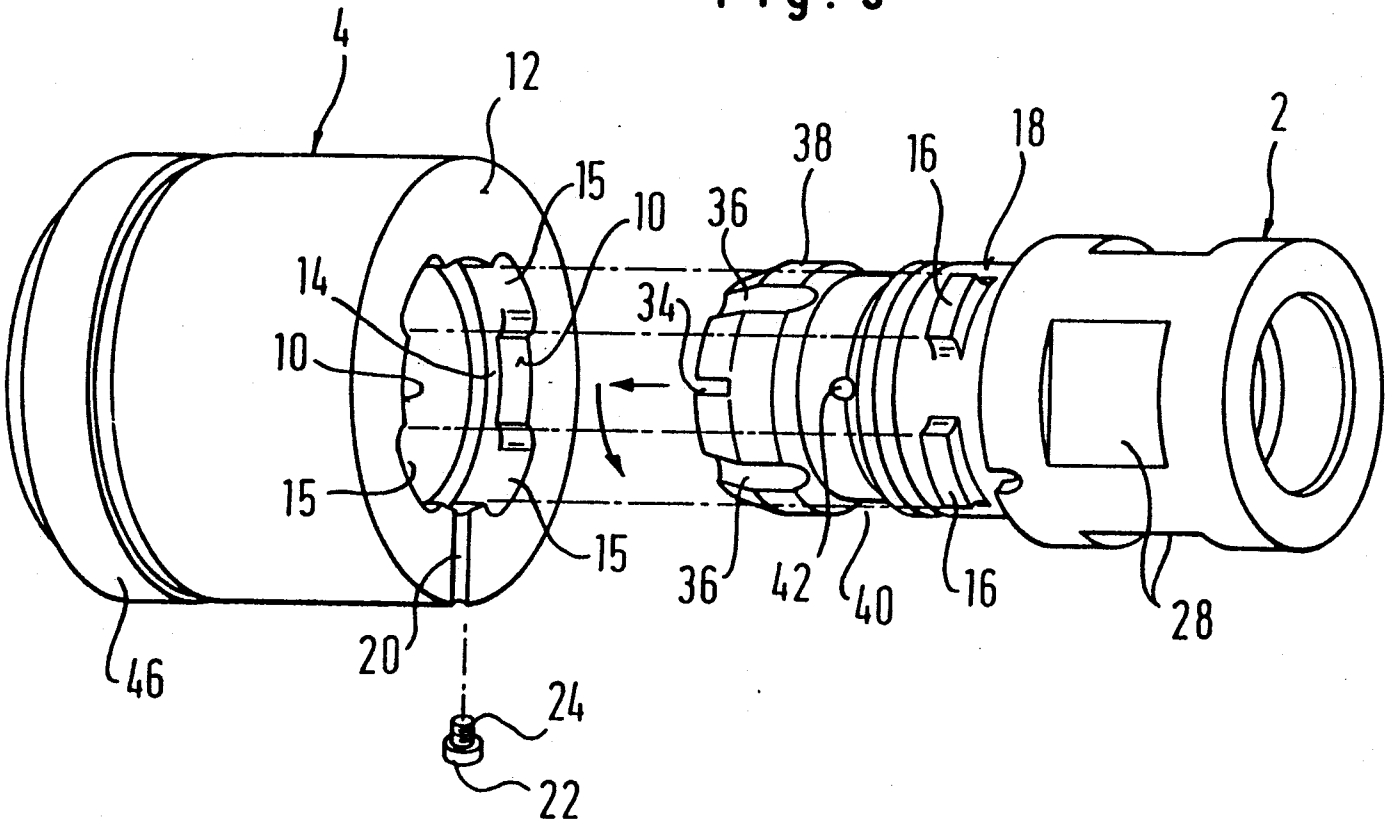
FIG. 5 is an exploded representation of a cap and a mounting piece.

In FIGS. 1, 2 and 5, a sealing ring 46 surrounds the front end of the cap 4. Another embodiment of the cap and sealing ring, which can be used independently from the cap 4 and mounting piece 2 arrangement as shown in FIGS. 1 to 5, is represented in FIG. 6.

Figure 6:
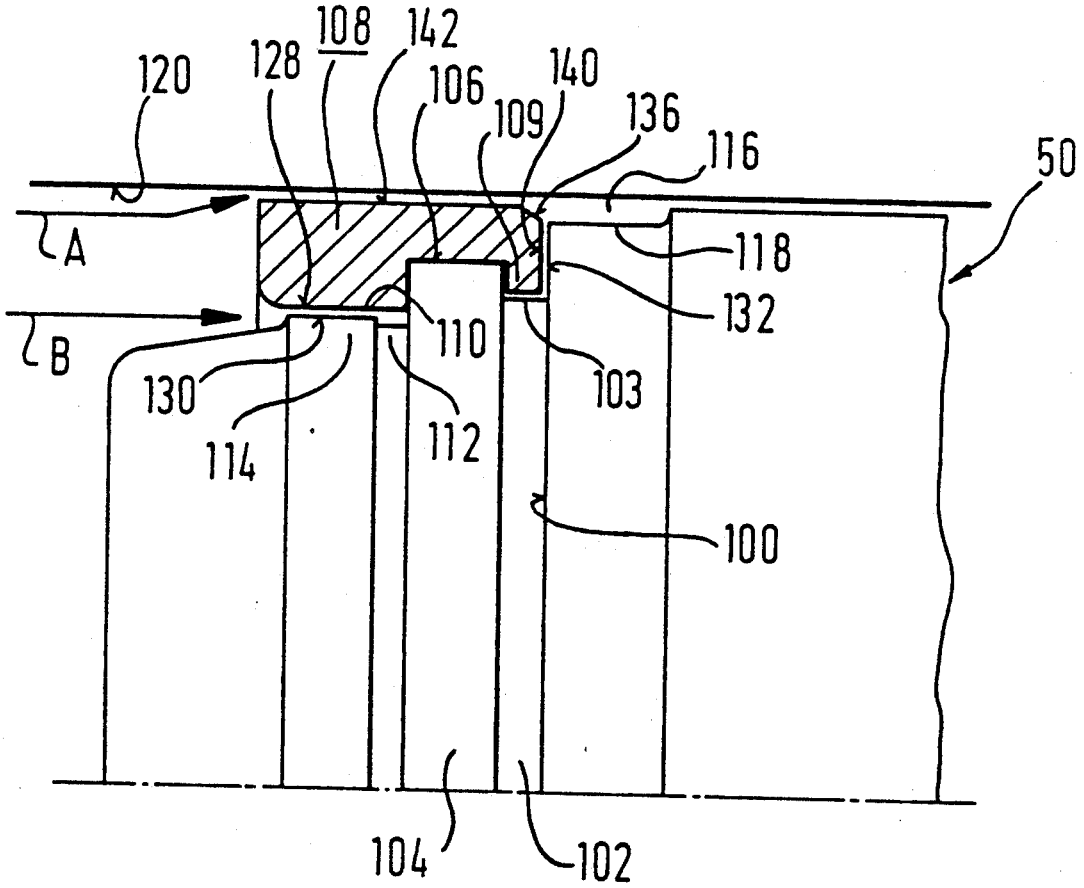
FIG. 6 is a side view, in partly truncated representation, showing a cap with its associated sealing ring.

FIG. 6 shows a cap 50 having an outer cover surface 100, and a cylindrical lug 102 having an outer ring land 104. The ring land 104 engages into an annular groove 106 in a sealing ring 108. The cylindrical lug 102 is provided with an annular recess 103, which serves to receive an inner ring land 109 of the sealing ring 108.

The sealing ring 108 and the lug 102 have mutually facing boundary surfaces 128, 130 which, on the front side, are initially parallel before diverging in a forward direction. An annular shoulder 132, radially bounded by the lug 102, of the outer cover surface 100 of the cap 50, faces, at a short distance apart, a rear boundary surface 140 of the sealing ring 108. The rear boundary surface 140 of the sealing ring 108 merges into the outer peripheral surface 142 of the sealing ring 108 via an ascending slope 136.

In front of the annular groove 106, the sealing ring 108 has a cylindrical inner peripheral surface, which forms a section of the boundary surface 128 and surrounds at a distance, two axially consecutive cylindrical outer peripheral sections 112, 114 of the cap 50. The front cylindrical outer peripheral section 114 has a larger diameter than the rear cylindrical outer peripheral section 112. The outer peripheral section 112 thus forms a retaining undercut for receiving solidified liquid metal.

Behind the sealing ring 108, the cap 50 has a section 118 of reduced diameter, which thereby forms a storage zone 116 between section 118 and the inner peripheral surface 120 of a casting cylinder.

The direction of flow of the liquid metal into the spaces between the sealing ring 108 and the cap 50, and in the axial direction over the outer peripheral surface 142 of the sealing ring 108, is indicated by the arrows A and B, respectively. In addition, the position is displaced within an inner peripheral surface 120 of a casting cylinder.

While specific embodiments of the invention have been described and illustrated, it will be clear that the invention is capable of modification. This application is intended to cover any variations, uses, or adaptations of the invention, following, in general, the principles of the invention and including such departures from the present disclosure as to come within knowledge or customary practice in the art to which the invention pertains and as may be applied to the essential features hereinbefore set forth and falling within the scope of the invention or the limits of the appended claims.

What is claimed is:

1. A piston in a casting cylinder of a die-casting press for forcing a liquid metal out of said casting cylinder comprising:

a mounting piece having an end surface and an outer peripheral surface; and a cap having an inner cover surface, an inner peripheral surface, and a free edge surface, said cap; being mounted on said mounting piece so that said inner cover surface faces said end surface;

wherein said inner peripheral surface has, proximate to said free edge surface, a plurality of notches formed therein, and said outer peripheral surface has a plurality of bayonet-catch projections extending therefrom which are received in said plurality of notches;

wherein said plurality of notches each have an axial dimension which is larger than an axial dimension of each of the bayonet-catch projections, thereby allowing said inner cover surface and said end surface to move relative to each other along a longitudinal axis of the piston, said axial dimension of said plurality of notches and said plurality of bayonet-catch projections being measured along the longitudinal axis of the piston; and wherein said mounting piece comprises annular peripheral supporting surfaces, located axially on both sides of said bayonet-catch projections and being in slidable contact with said inner peripheral surface of said cap.

2. A piston as claimed in claim 1, wherein said bayonet-catch projections are disposed around said outer peripheral surface such that an angular distance between any two adjacent projections is equal, each of said bayonet-catch projections corresponding to one of said plurality of notches.

3. A piston as claimed in claim 2, wherein there are four of said plurality of notches.

4. A piston as claimed in claim 1, wherein said axial dimension of said plurality of notches are 0.1 mm to 0.2 mm larger then said axial dimension of said plurality of bayonet-catch projections.

5. A piston as claimed in claim 1, wherein said free edge surface has a rounded recess therein for receiving a head portion of a screw which is screwed into said mounting piece.

6. A piston for forcing liquid metal out of a casting cylinder of a die-casting press, comprising:

a mounting piece having an end surface;

a cap having an inner cover surface and a front peripheral section, said front peripheral section including an outer ring land, and first and second axially aligned cylindrical outer peripheral sections, a diameter of said first cylindrical outer peripheral section being larger than a diameter of said second cylindrical outer peripheral section; and a sealing ring having an inner annular groove in which said outer ring land is embraced, and a cylindrical inner peripheral surface being adjacent said annular groove and surrounding said first and second axially aligned cylindrical outer peripheral sections at a distance therefrom;

wherein said cap is mounted on said mounting piece so that the inner cover surface faces the end surface;

wherein said mounting piece has an outer peripheral surface, said cap has a free edge surface and an inner peripheral surface, said inner peripheral surface of said cap has, proximate to said free edge surface, a plurality of notches formed therein, and said outer peripheral surface of said mounting piece has a plurality of bayonet-catch projections extending therefrom which are received in said plurality of notches.

7. A piston as claimed in claim 6, wherein there are four bayonet-catch projections disposed around said outer peripheral surface of said mounting piece such that an angular distance between any two adjacent bayonet-catch projections is equal, each of said bayonet-catch projections corresponding to one of said plurality of notches.

8. A piston as claimed in claim 7, wherein there are four of said plurality of notches.

9. A piston as claimed in claim 8, wherein said plurality of notches each have an axial dimension which is larger than an axial dimension of each of the bayonet-catch projections, thereby allowing said inner cover surface and said end surface to move relative to each other along a longitudinal axis of the piston, said axial dimensions of said plurality of notches and said plurality of bayonet-catch projections being measured along the longitudinal axis of the piston.

10. A piston as claimed in claim 6, wherein said plurality of notches each have an axial dimension, which is larger than an axial dimension of each of the bayonet-catch projections, thereby allowing said inner cover surface and said end surface to move relative to each other along a longitudinal axis of the piston, said axial dimensions of said plurality of notches and said plurality of bayonet-catch projections being measured along the longitudinal axis of the piston.

11. A piston as claimed in claim 10, wherein said free edge surface has a rounded recess therein for receiving a head portion of a screw which is screwed into said mounting piece.

12. A piston in a casting cylinder of a die-casting press for forcing liquid metal out of said casting cylinder comprising:

a mounting piece having an end surface;

a cap having a front face, an inner cover surface and a front peripheral section, a sealing ring having an inner annular groove in which an outer ring land of said cap is embraced, and having first and second cylindrical inner peripheral surfaces, being adjacent each side of said annular groove which, respectively, are displaced from and surround first and second axially aligned cylindrical outer peripheral sections, of said cap;

wherein the diameters of said second inner peripheral surface and said second cylindrical outer peripheral section are nearer to said front face of said cap and are smaller than the diameters of said first inner peripheral surface and said first cylindrical outer peripheral section; and wherein said cap is mounted on said mounting piece so that the inner cover surface faces the end surface.

13. A piston as claimed in claim 12, wherein said cap has a section having the diameter which is less than a diameter of the inner peripheral surface of said casting cylinder such that a storage zone is formed between said section and said inner peripheral surface of the casting cylinder.

14. A piston as claimed in claim 12, wherein a cylindrical section of said cap having a smaller diameter than the diameter of said second cylindrical outer peripheral section is disposed between said second cylindrical outer peripheral section of said cap and said ring land of said cap such that an undercut is formed between said ring land and said second cylindrical outer peripheral section for receiving solidified liquid metal.

15. A piston for forcing a liquid metal out of a casting cylinder of a die-casting press, comprising:

a mounting piece having an end surface and an outer peripheral surface; and a cap having an inner cover surface, an inner peripheral surface, and a free edge surface, said cap being mounted on said mounting piece so that said inner cover surface faces said end surface;

wherein said inner peripheral surface has, proximate to said free edge surface, a plurality of notches formed therein, and said outer peripheral surface has a plurality of bayonet-catch projections extending therefrom which are received in said plurality of notches;

wherein said plurality of notches each have an axial dimension which is larger than an axial dimension of each of the bayonet-catch projections, thereby allowing said inner cover surface and said end surface to move relative to each other along a longitudinal axis of the piston, said axial dimension of said plurality of notches and said plurality of bayonet-catch projections being measured along the longitudinal axis of the piston; and wherein said axial dimension of said plurality of notches are 0.1 mm to 0.2 mm larger than said axial dimension of said plurality of bayonet-catch projections;

wherein said cap has a section having a diameter which is less than a diameter of the inner peripheral surface of the casting cylinder such that a storage zone is formed between said section and said inner peripheral surface of the casting cylinder.

* * * * *